US011565309B2

(12) United States Patent
Stavenow et al.

(10) Patent No.: US 11,565,309 B2
(45) Date of Patent: Jan. 31, 2023

(54) STRAND GUIDE SEGMENT AND CONTINUOUS CASTING PLANT

(71) Applicant: SMS GROUP GMBH, Düsseldorf (DE)

(72) Inventors: Axel Stavenow, Düsseldorf (DE); Alexander Raile, Mettmann (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 16/761,838

(22) PCT Filed: Oct. 2, 2018

(86) PCT No.: PCT/EP2018/076752
§ 371 (c)(1),
(2) Date: May 6, 2020

(87) PCT Pub. No.: WO2019/091664
PCT Pub. Date: May 16, 2019

(65) Prior Publication Data

US 2021/0197251 A1 Jul. 1, 2021

(30) Foreign Application Priority Data

Nov. 7, 2017 (DE) ..... 10 2017 219 740.4

(51) Int. Cl.
*B22D 11/128* (2006.01)
*B22D 11/20* (2006.01)
*B22D 11/12* (2006.01)

(52) U.S. Cl.
CPC ..... *B22D 11/128* (2013.01); *B22D 11/1206* (2013.01); *B22D 11/20* (2013.01)

(58) Field of Classification Search
CPC ..... B22D 11/12; B22D 11/128; B22D 11/20; B22D 11/1206
USPC ..... 164/413, 454, 484, 441, 442, 447, 448
See application file for complete search history.

(56) References Cited

U.S. PATENT DOCUMENTS

| | | | |
|---|---|---|---|
| 4,432,407 | A | 2/1984 | Scheurecker |
| 5,115,857 | A | 5/1992 | Schertler |
| 5,433,265 | A | 7/1995 | Rahmfeld |
| 2008/0147349 | A1 | 6/2008 | Wilmes |

FOREIGN PATENT DOCUMENTS

| | | | |
|---|---|---|---|
| DE | 1963146 | A1 | 2/1974 |
| DE | 4306853 | A1 | 9/1994 |
| EP | 0030223 | A2 | 6/1981 |
| EP | 0618024 | B1 | 10/1994 |

(Continued)

*Primary Examiner* — Kevin P Kerns
(74) *Attorney, Agent, or Firm* — Lucas & Mercanti, LLP; Klaus P. Stoffel

(57) ABSTRACT

A strand guide segment for a continuous casting plant, which strand guide segment has an upper frame, a lower frame and position-controlled hydraulic cylinder units for setting the distance between the upper frame and the lower frame and, as a result, a strand thickness of a strand to be guided by the strand guide segment. A first end of each hydraulic cylinder unit is mounted on the upper frame. At the second end of the hydraulic cylinder units, facing away from the upper frame, each hydraulic cylinder unit is detachably connected by a respective flange connection to a respective tie rod which, at its end facing away from the flange connection, is mounted on the lower frame.

10 Claims, 2 Drawing Sheets

(56) References Cited

FOREIGN PATENT DOCUMENTS

| | | | |
|---|---|---|---|
| EP | 0467877 | B1 | 12/1994 |
| EP | 1754556 | A2 | 2/2007 |
| WO | 2006050868 | A1 | 5/2006 |
| WO | 2015091080 | A1 | 6/2015 |

STRAND GUIDE SEGMENT AND CONTINUOUS CASTING PLANT

CROSS-REFERENCE TO RELATED APPLICATIONS

The present application is a 371 of International application PCT/EP2018/076752, filed Oct. 2, 2018, which claims priority of DE 10 2017 219 740.4, filed Nov. 7, 2017, the priority of these applications is hereby claimed and these applications are incorporated herein by reference.

BACKGROUND OF THE INVENTION

The present invention relates to a strand guide segment for a continuous casting plant. A continuous casting plant is also a subject matter of the invention.

In present continuous casting plants for metals, in particular steel materials, the liquid metal is first incorporated in a permanent mold and is subsequently guided as a strand in a partially solidified state through a strand guide, also referred to as a support roller stand, having rollers.

It is known from DE 19 63 146 C1 for parts of the support roller stand for a plurality of rollers to be combined so as to form strand guide segments, wherein each strand guide segment has an upper frame and a lower frame opposite the upper frame, said upper frame and said lower frame supporting strand-guiding rollers, and the mutual spacing of said upper frame and said lower frame being capable of being set to the casting format by way of tension rods and spaces. The upper frame and the lower frame of a respective strand guide segment are clamped relative to one another by four hydraulic cylinder units which are disposed on the four external corners outside the strand path and connect the upper frame and the lower frame to one another.

A strand guide having strand guide segments in which the respective upper frame and lower frame are connected to one another by way of hydraulic cylinder units and are capable of being actuated in a controlled manner relative to one another is known from WO 2006/050868 A1. The hydraulic cylinder units are assembled so as to be mounted on the upper frame and the lower frame.

The upper frame and the lower frame on strand guide segments of this type have to be separated or uncoupled, respectively, from one another for maintenance purposes. To this end, the respective mountings of the hydraulic cylinder units on the upper frame or the lower frame have to be opened. In order for a mounting of this type to be able to be readily opened, a sufficiently large clearance has to be provided for said mounting. An implementation of this type however has a disadvantageous effect in terms of the accuracy of the strand thickness set by the strand guide segment. Therefore, large deviations between the strand thickness actually set by the strand guide segment and the nominal strand thickness can arise.

SUMMARY OF THE INVENTION

The present invention is therefore based on the object of providing a strand guide segment for a continuous casting plant that guarantees simple maintenance and at the same time greater accuracy of the strand thickness set by the strand guide segment in comparison to the prior art. Moreover, the present invention is to provide a continuous casting plant which can be readily serviced and guarantees a high accuracy of the strand thickness which is in each case set by the strand guide segments of said continuous casting plant.

The proposed strand guide segment for a continuous casting plant for metals, in particular steel materials, has an upper frame and a lower frame, said upper frame and said lower frame being connected to one another by way of positionally controlled hydraulic cylinder units during a casting operation of the continuous casting plant. The hydraulic cylinder units are disposed and configured for setting a spacing between the upper frame and the lower frame, wherein the set spacing predefines or sets, respectively, a strand thickness of a strand to be guided by the strand guide segment. Each hydraulic cylinder unit has a piston rod which by means of an applied hydraulic pressure is capable of being deployed or retracted, respectively, in a positionally controlled manner so as to increase or to decrease, respectively, the spacing between the upper frame and the lower frame. The proposed strand guide segment preferably has two pairs of hydraulic cylinder units which are disposed on both sides and outside the strand path of the strand guide segment. The strand guide segment on both sides of the strand path preferably has in each case one lateral frame, said lateral frames permitting a guided movement of the upper frame and of the lower frame relative to one another as a response to deflections or variations in length, respectively, of the hydraulic cylinder units. A first end of each of the hydraulic cylinder units is mounted on the upper frame. Furthermore, each of the hydraulic cylinder units, specifically the piston rod thereof, at the second end thereof that faces away from the upper frame, by means of a respective flange device is releasably connected to a respective tie rod. The tie rods, at the end thereof that faces away from the flange device, are mounted on the lower frame. Each hydraulic cylinder unit, more specifically the piston rod thereof, by way of the respective flange device is preferably rigidly connected to the respective tie rod. Length variations of the hydraulic cylinder units mounted on the upper frame that are caused by position control are converted to a corresponding variation of the spacing between the upper frame and the lower frame by way of the tie rods mounted on the lower frame. The tie rods are preferably designed so as not to be variable in terms of length.

The provision of the flange devices by way of which a respective hydraulic cylinder unit, or the piston rod thereof, respectively, is releasably connected to a respective tie rod enables a simple separation of the upper frame from the lower frame without the mountings of the hydraulic cylinder units on the upper frame having to be opened. The mountings of the hydraulic cylinder units thus do not have to be provided with a large clearance. The mountings are therefore capable of being designed with little clearance, on account of which the proposed strand guide segment guarantees a high precision in terms of the set strand thickness.

In one refinement of the proposed strand guide segment it is provided that the hydraulic cylinder units, in particular the piston rods thereof, by way of the respective flange devices are screw-fitted to the respective tie rods. Simple releasing of the hydraulic cylinder units from the tie rods, this being equivalent to a simple separation of the upper frame from the lower frame during maintenance, and at the same time a connection of high tensile strength between the hydraulic cylinder devices and the tie rods during the casting operation, is enabled on account of the screw fittings.

In one refinement of the proposed strand guide segment it is provided that the tie rods are releasably connected to the respective flange device thereof. It is moreover provided in one refinement of the proposed strand guide segment that the hydraulic cylinder units are releasably connected to the respective flange device. If a respective flange connection is releasably connected to the respective tie rod as well as to the respective hydraulic cylinder unit, the flange connection can thus be dismantled in particularly simple manner in the case of maintenance work and be checked for wear. It can also be provided that the respective flange device is thermally shrink-fitted onto the respective hydraulic cylinder unit, in particular onto the piston rod of the latter, and said flange device is screw-fitted to the respective tie rod. However, it can also be provided that the flange device is fixedly connected to one of the group of the hydraulic cylinder unit and the tie rod, and the flange device is releasably connected, in particular screw-fitted, to the other of the group of the hydraulic cylinder unit and the tie bar.

In one refinement of the proposed strand guide segment it is provided that the hydraulic cylinder units are mounted, by means of joint bearings on bolts, on the upper frame. A particularly low-clearance mounting of the hydraulic cylinder units is implemented on account thereof such that the proposed strand guide segment by virtue of the low-clearance linkage between the upper frame and the lower frame guarantees a high precision in terms of the set strand thickness.

In one refinement of the proposed strand guide segment it is proposed that the tie bars are mounted by means of joint bearings on bolts on the lower frame. A particularly low-clearance mounting of the tie rods is implemented on account thereof such that the proposed strand guide segment by virtue of the low-clearance linkage between the upper frame and the lower frame guarantees a high precision in terms of the set strand thickness.

The hydraulic cylinder units as well as the tie rods are preferably mounted by means of joint bearings on bolts on the frames assigned to said hydraulic cylinder units and tie rods. The proposed strand guide segment on account thereof guarantees a particularly high precision in terms of the set strand thickness.

In refinements of the proposed strand guide segment it is furthermore proposed that the hydraulic cylinder units and/or the tie rods are in each case clamped in the frame assigned thereto by split bearing shells and a split bearing block. A low-clearance linkage between the upper frame and the lower frame is achieved on account thereof such that the proposed strand guide segment enables a high precision in terms of the set strand thickness. At the same time, the hydraulic cylinder units and/or the tie rods can be released without great technical complexity from the upper frame or the lower frame, respectively, for the purpose of maintenance or repair.

In one refinement of the proposed strand guide segment it is moreover provided that the hydraulic cylinder units on the first end thereof have in each case one bearing block, for example in the manner that the first end of a respective hydraulic cylinder unit is configured as a bearing block for one of the bolts mentioned above.

A position-measuring sensor which measures the deflection of the piston rod of a respective hydraulic cylinder unit and generates a corresponding measuring signal for transmission to a controller for controlling the position, or the strand thickness, respectively, is assembled laterally on said bearing block. By virtue of the position-measuring sensors being assembled laterally on the upper bearing blocks of the hydraulic cylinder units, simple servicing of the sensors in the continuous casting plant is possible without disassembling the strand guide segment.

The object of the present invention is furthermore also achieved by a continuous casting plant, the strand guide thereof having at least one of the strand guide segments proposed above. The entire strand guide is preferably composed of a plurality of the proposed strand guide segments. The proposed continuous casting plant enables simple servicing of the individual strand guide segments and minimizing of deviations between actual strand thicknesses in the strand guide and strand thicknesses predefined by the position control.

The invention comprises arbitrary combinations of the strand guide segment proposed above with the continuous casting plant proposed above and with the respective refinements.

In order for the strand guide segment proposed according to the present invention to be explained in more detail, exemplary embodiments will now be proposed with reference to the figures hereunder, wherein similar or identical components are provided with the same reference signs in all the figures.

DETAILED DESCRIPTION OF THE INVENTION

Figure 1:
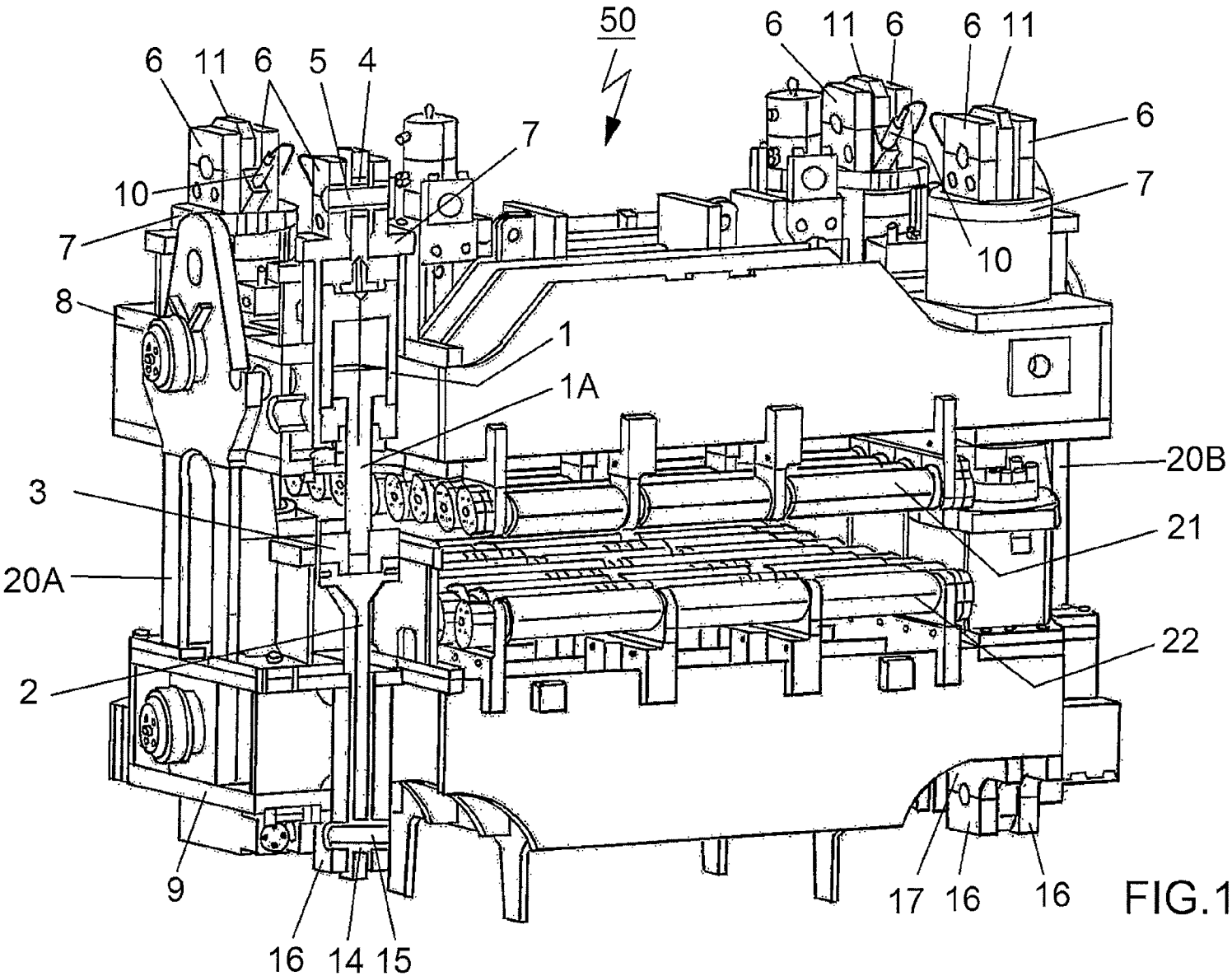
FIG. 1 visualizes in a perspective illustration and by way of a simplified partial sectional view an exemplary embodiment of the proposed strand guide segment.

An exemplary embodiment of the proposed strand guide segment is visualized in a perspective illustration in FIG. 1. The strand guide segment 50 has an upper frame 8 and a lower frame 9, the mutual spacing of said upper frame 8 and said lower frame 9 along the guide being variable by lateral frames 20A and 20B. The strand guide segment 50 is configured for guiding a strand, in particular from partially solidified metal, and for setting the strand thickness of said strand. For this purpose, rollers 21 mounted on the upper frame 8 and rollers 22 mounted on the lower frame 9 are provided, the strand being guided between said rollers 21, 22, and wherein a spacing between the rollers 21 and 22 determines the strand thickness set by the strand guide segment 50. The spacing is set by four hydraulic cylinder units 1 having tie rods 2 which are in each case connected to said hydraulic cylinder units 1 and which are disposed on the four external corners of the strand guide segment 50.

The hydraulic cylinder units 1 by means of a respective flange device 3 are releasably connected to the respective tie rod 2. The end of each hydraulic cylinder unit 1 that faces the upper frame 8 is designed as a bearing block 11, a position-measuring sensor 10 being assembled laterally on said bearing block 11. The bearing block 11 is configured for receiving a bolt 5 which in turn is clamped in the upper frame 8 by way of split bearing shells 6 and a split bearing block 7 which are provided, or assembled, respectively, on the upper frame 8. The bearing block 11 of a respective hydraulic cylinder unit 1 is mounted on the bolt 5 by means of a joint bearing 4 which is configured so as to be low-clearance. Each hydraulic cylinder unit 1 is axially aligned in the direction of the lower frame 9, wherein each hydraulic cylinder unit 1 on the end thereof that faces away from the upper frame 8 has a piston rod 1A. Said piston rod 1A is connected to the flange device 3 which in turn is connected to the tie rod 2.

The tie rod 2 at the end thereof that faces away from the flange device 3 is mounted on the lower frame 9. More specifically, the tie rod 2 at this end by means of a low-clearance joint bearing 14 is mounted on a bolt 15. The bolt 15, and thus also the tie rod 2, by means of split bearing shells 16 and a split bearing block 17 is clamped in the lower frame 9.

The front left portion of the strand guide segment 50 in a simplified perspective sectional view of the hydraulic cylinder unit 1 having the piston rod 1A thereof, the flange device 3, the tie rod 2, the joint bearings 4, 14, the bolts 5, 15, and the split bearing shells 6, 16 is illustrated in FIG. 1. In contrast, this sectional view is illustrated in detail in a two-dimensional manner in FIG. 2. In the exemplary embodiment visualized, the flange device 3 is connected in a force-fitting manner to the end portion of the piston rod 1A that faces away from the upper frame 8. For example, the flange device 3 may have been thermally shrink-fitted onto the end portion of the piston rod 1A. The flange device 3 by means of a plurality of screws 12 which are aligned in the axial direction of the piston rod 1A is connected to the end portion of the tie rod 2 that faces away from the lower frame 9 and is designed so as to be widened. The screws 12 during the casting operation establish a rigid connection between the piston rod 1A and the tie rod 2. The screws 12 can be released for maintenance work such that the flange device 3 and thus also the piston rod 1A of the hydraulic cylinder unit 1 can be separated, or uncoupled, respectively, from the tie rod 2. On account thereof, the upper frame 8 can be separated from the lower frame 9 in the case of maintenance work without the bearings on the upper frame or the lower frame having to be opened.

Figure 2A:
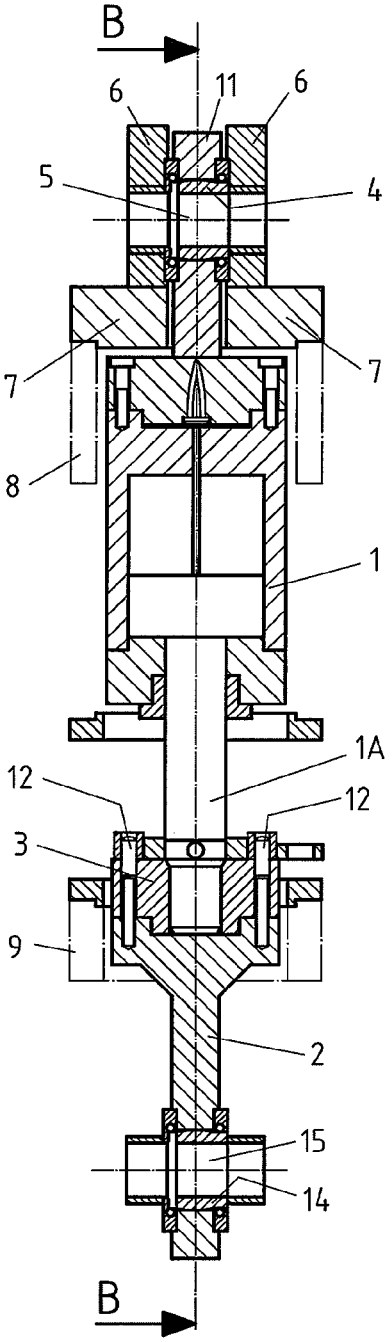
FIG. 2A illustrates a detailed sectional view of the portion of the exemplary embodiment of the proposed strand guide segment which is illustrated as a simplified partial sectional view in FIG. 1.
Figure 2B:
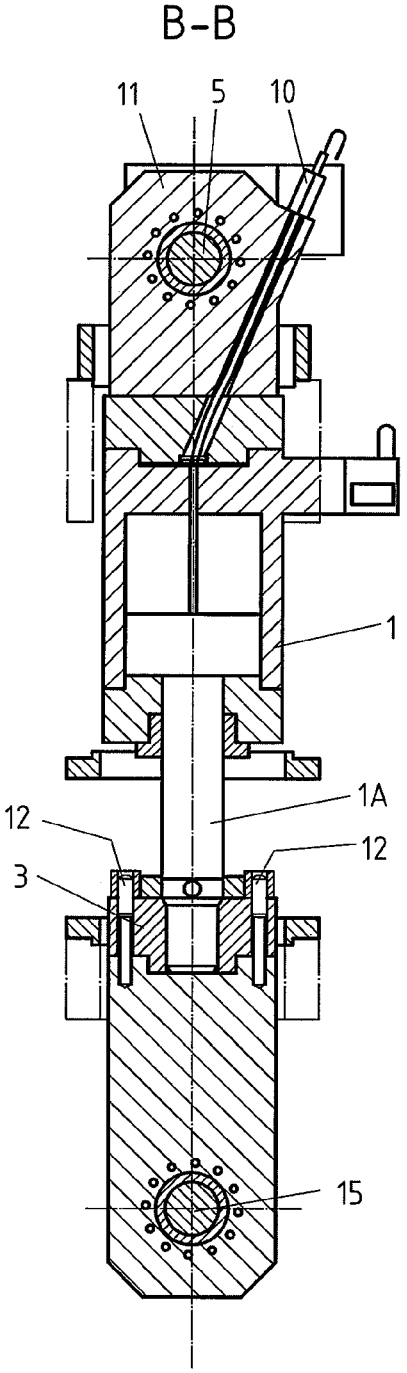
FIG. 2B shows a lateral sectional view of the components of the exemplary embodiment of the strand guide segment visualized in FIG. 2A.

FIG. 2B shows a view of a section along the lines B-B in FIG. 2A. As can be seen from FIG. 2B, the position-measuring sensor 10 in the region of the upper frame 8 is attached laterally to the bearing block 11 of the hydraulic cylinder unit 1. The position-measuring sensor 10 can therefore be serviced in a simple manner in the continuous casting plant without disassembling the strand guide segment 50.

LIST OF REFERENCE SIGNS

1 Hydraulic cylinder unit
1A Piston rod of the hydraulic cylinder unit
2 Tie rod
3 Flange device
4, 14 Joint bearing
5, 15 Bolt
6, 16 Split bearing shells
7, 17 Split bearing block
8 Upper frame
9 Lower frame
10 Position-measuring sensor
11 Bearing block
12 Screw
20A, 20B Lateral frame
21, 22 Rollers
50 Strand guide segment

The invention claimed is:

1. A strand guide segment for a continuous casting plant, comprising: an upper frame; a lower frame; and positionally controlled hydraulic cylinder units for setting a spacing between the upper frame and the lower frame and thereby a strand thickness of a strand guided by the strand guide segment, wherein a first end of each hydraulic cylinder unit is mounted on the upper frame, wherein each hydraulic cylinder unit, at a second end that faces away from the upper frame, has a piston rod with a lower end that is detachably connected to a respective flange device that is connected to a first, upper end of a respective tie rod, wherein a second, lower end of the respective tie rod that extends away from the flange device is mounted on the lower frame.

2. The strand guide segment according to claim 1, wherein the hydraulic cylinder units by way of the respective flange devices are screw-fitted to the respective tie rods.

3. The strand guide segment according to claim 1, wherein the respective tie rods are releasably connected to the respective flange device.

4. The strand guide segment according to claim 1, wherein the hydraulic cylinder units are releasably connected to the respective flange devices.

5. The strand guide segment according to claim 1, wherein the hydraulic cylinder units are mounted by joint bearings on bolts on the upper frame.

6. The strand guide segment according to claim 1, wherein the tie rods are mounted by joint bearings on bolts on the lower frame.

7. The strand guide segment according to claim 1, wherein the hydraulic cylinder units are in each case clamped in the upper frame by split bearing shells and a split bearing block.

8. The strand guide segment according to claim 1, wherein the respective tie rods are in each case clamped in the lower frame by split bearing shells and a split bearing block.

9. The strand guide segment according to claim 1, wherein the hydraulic cylinder units at the first end thereof have in each case one bearing block having a laterally assembled position-measuring sensor.

10. A continuous casting plant comprising a strand guide which has at least one strand guide segment according to claim 1.

* * * * *